United States Patent [19]

Ensminger

[11] Patent Number: 4,496,207

[45] Date of Patent: Jan. 29, 1985

[54] ELECTRICAL CONNECTOR WITH DUAL POSITION LATCHES

[75] Inventor: Joseph M. Ensminger, Long Lake, Minn.

[73] Assignee: E. I. Du Pont de Nemours and Company, Wilmington, Del.

[21] Appl. No.: 153,207

[22] Filed: May 27, 1980

Related U.S. Application Data

[63] Continuation of Ser. No. 962,077, Nov. 20, 1978, abandoned, which is a continuation-in-part of Ser. No. 824,156, Aug. 12, 1977, abandoned.

[51] Int. Cl.[3] ..... H01R 13/38

[52] U.S. Cl. ..... 339/99 R

[58] Field of Search ..... 339/98, 99 R

[56] References Cited

U.S. PATENT DOCUMENTS

| | | | |
|---|---|---|---|
| 3,012,219 | 12/1961 | Levin et al. | 339/98 |
| 3,213,404 | 10/1965 | Hedstrom | 339/97 R |
| 3,434,093 | 3/1969 | Wedekind | 339/99 R |
| 3,573,713 | 4/1971 | Enright et al. | 339/98 |
| 3,718,888 | 2/1973 | Pasternak | 339/98 |
| 3,812,449 | 5/1974 | Elm | 339/98 |
| 3,816,818 | 6/1974 | Meier | 339/99 R |
| 3,985,416 | 10/1976 | Dola et al. | 339/98 |
| 3,994,554 | 11/1976 | Navarro | 339/99 R |
| 4,006,957 | 2/1977 | Marozny | 339/99 R |
| 4,068,912 | 1/1978 | Hudson et al. | 339/99 R |
| 4,145,103 | 3/1979 | Knowles | 339/99 R |

FOREIGN PATENT DOCUMENTS

| | | |
|---|---|---|
| 312726 | 1/1974 | Austria . |
| 2289054 | 5/1976 | France . |
| 7405380 | 11/1974 | Netherlands . |
| 7505725 | 5/1975 | Netherlands . |
| 1491694 | 11/1977 | United Kingdom . |

*Primary Examiner*—Joseph H. McGlynn

[57] ABSTRACT

An electrical connector for multi-conductor, flat cables. The connector includes a base member with insulation-displacing contacts projecting from its top and a cover member apertured to receive the contacts. A slot in the cover member receives the cable. The cover and base are held in a preassembly by a latch yoke positioned between two stops. In a final assembly, the latch yoke is beyond both stops.

1 Claim, 6 Drawing Figures

ELECTRICAL CONNECTOR WITH DUAL POSITION LATCHES

CROSS-REFERENCE TO RELATED APPLICATION

This application is a continuation of application Ser. No. 962,077 filed Nov. 20, 1978, now abandoned, which is a continuation-in-part of application Ser. No. 824,156 filed Aug. 12, 1977, now abandoned.

BACKGROUND OF THE INVENTION

This disclosure relates generally to the termination of flat cables and, more particularly, to a latching arrangement for the base and cover of a connector for such cables.

A flat cable connector with a cable guide slot in the cover and a latching arrangement with a complemental base is produced by the assignee and shown in Berg Bulletin 131B. After a cable is placed in the guide slot, the cover is then latched to the base. During shipment, handling and assembly, the exposed tines on the insulation-displacing contacts are sometimes bent or misaligned.

A preassembly latch for a different type of cable connector is shown in U.S. Pat. No. 4,006,957 to Narozny.

SUMMARY OF THE INVENTION

The cable connector disclosed and claimed herein has a base member with insulation-displacing contacts and a cover member apertured to receive the contacts. A slot in the cover receives the cable. The base and cover are latched in a preassembly position by a latch yoke located between spaced stops. In the preassembly, tines on the contacts are enclosed within the cover but the slot is clear to receive a cable. When the base and cover are moved together, the latch yoke is beyond the stops in a fully latched position.

BRIEF DESCRIPTION OF THE DRAWINGS

Worthwhile objectives and advantages of the connector will be apparent from the following description wherein reference is made to the drawing in which.

DETAILED DESCRIPTION OF A PREFERRED EMBODIMENT

Figure 1:
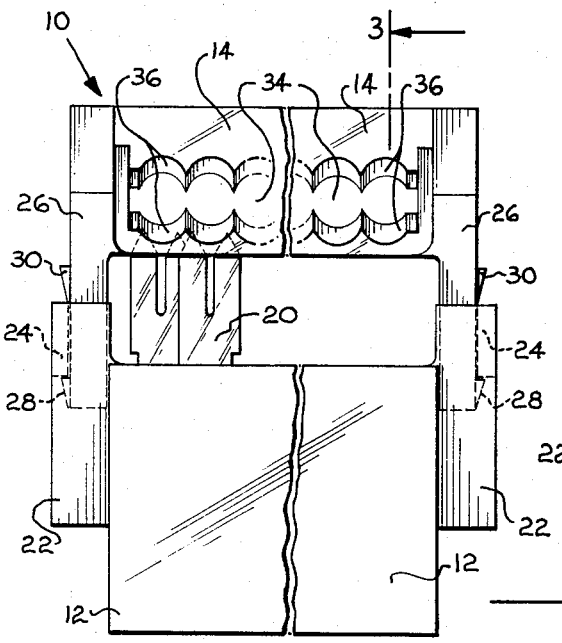
FIGS. 1, 2 and 3 are side, end and transverse sectional views of the connector in its preassembly position.

In FIGS. 1–5, the connector chosen for purposes of illustration has been designated 10 and includes generally, as members thereof, a base 12 and a cover 14. Base 12 and cover 14 are molded from a 30% glass filled polyester.

Base 12 is an elongated, rectangular block with two rows of cavities 16, each of which receives the mounting channel and pin-receiving contact of a metallic terminal 18. Terminals 18 also have insulation-displacing contacts 20 in the form of skewed tines that project from cavities 16 beyond the upper surface of base 12. In the lower surface of base 12, there are openings to each cavity 16 for the reception of pins mounted in a pin field or a header.

At each end, base 12 has an integral latch yoke 22 including a pair of arms that extend upwardly from the base and are joined by a crosspiece 24. Crosspieces 24 are of lesser thickness than the arms and thus leave a passage for reception of beams 26 that depend from integral lugs on the ends of cover 14.

Figure 2:
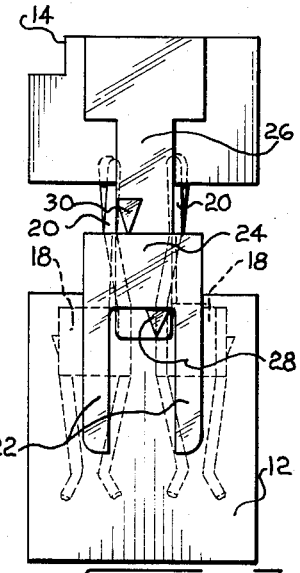
Figure 3:
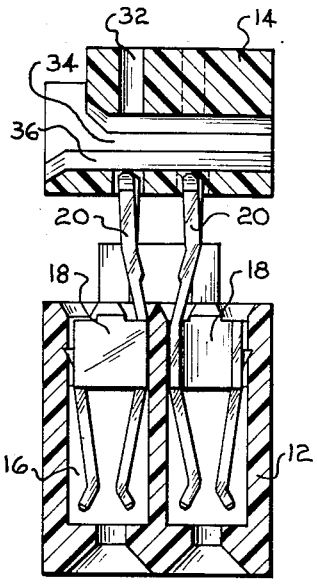
Figure 5:
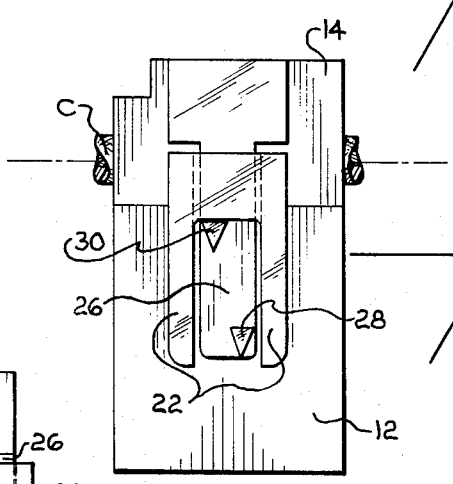
FIGS. 4 and 5 are side and end views of the assembled connector.
Figure 4:
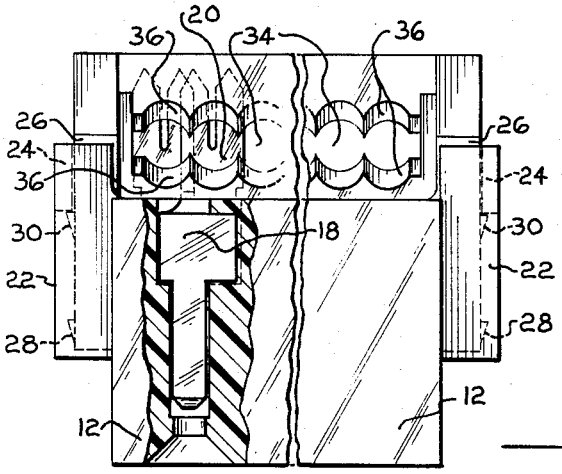

Beams 26 have spaced tops 28, 30 between which a crosspiece 24 is located when the base and cover members are preassembled (FIGS. 1–3). During preassembly, the tines on any misaligned terminals 18 engage cover 14 in lower apertures 32 and the terminals are thereby realigned. Another advantage is that, in the preassembly position, the ends of the tines of contacts 20 are in the lower ends of apertures 32, i.e., are enclosed in and protected by cover 14.

Cover 14 has a slot 34 extending therethrough. Slot 34 is enlarged at one end for the reception of a round conductor, flat, flex cable C and is defined by upper and lower surfaces having opposed scallops 36. The enlargement or lead-in to slot 34 is especially useful in the placement of wrinkled and bent cables.

With the base and cover members in the preassembled position, the tines on contacts 20 are protected by cover 14 and slot 34 is free for the reception of a cable C. Since the ends of the contact tines are within apertures 32, slot 34 provides an unrestricted guided entry for cable C. Then, the subassembly is located in a press and cover 14 is moved toward base 12. Each contact 20 pierces the insulation of cable C and engages a conductor in the gap between its tines. Stops 30 stress crosspieces 24 and move beyond to the fully latched position shown in FIG. 5. After the free end of cable C is bent back over the top of cover 14 and a strain relief is applied, the subassembly is ready for placement in a header or on a pin field.

In the cable C shown herein, multiple insulated conductors are interconnected by webs of a plastic adhesive. Thus, both surfaces are ribbed and fit in the opposed scallops 36 in guide slot 34. Another available cable has ribs on one side but is flat on the other side. Such cables are usually inserted with the ribbed side up. With the conductors in the upper scallops 36, there is no chance of displacement by the contact tines. A guide slot 34 with opposed scallops 36 is also advantageous in the occasional situation where a cable with one flat surface must be inverted, i.e., have its conductors in the lower scallops.

Figure 6:
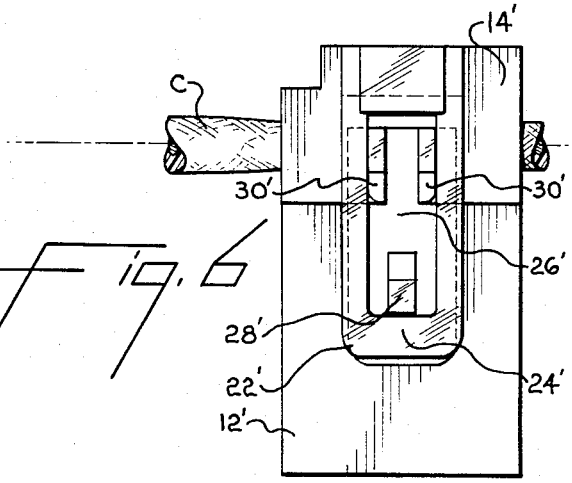
FIG. 6 is an end view of an alternate embodiment.

In the embodiment of FIG. 6, latching yoke 22' depends from the ends of cover 14'. Stops 28', 30' are on beam 26' and the beam extends upwardly from base 12'. The provision of spaced stops 30' prevents lateral movements of cover 14' when crosspiece 24' is in its preassembly position between stops 20', 30'.

What is claimed is:

1. In a connector for terminating a multiconductor flat cable having a base member with insulation-displacing contacts projecting therefrom, a unitary cover member having a guide slot therein containing spaced parallel scalloped surfaces for receiving a cable and apertures for receiving said contacts and a latching arrangement to hold the base and cover together in the assembled position, the improvement comprising, having a dual latch arrangement wherein said cover member has a single parallel beam projecting from each side therefrom with a pair of integral spaced stops one above the other on each of said beams and said base member has an integral latching yoke with a pair of arms that extend upwardly from said base at each end, each said yoke having a crosspiece separating said arms located between stops in a pre-assembly position and beyond the stops in a latched position of the cover member with respect to the base member, each said beam being slidable between the arms of the yoke and between the cross-piece and the side wall of said base member, the ends of said contacts being enclosed in said apertures in the pre-assembly position and projecting through the guide slots in the latched position.

* * * * *